United States Patent [19]

Dougherty, Jr. et al.

[11] Patent Number: 5,040,609

[45] Date of Patent: Aug. 20, 1991

[54] FIRE EXTINGUISHING COMPOSITION AND PROCESS

[75] Inventors: Alfred P. Dougherty, Jr., Wilmington; Richard E. Fernandez, Bear; Daniel W. Moore, Wilmington, all of Del.

[73] Assignee: E. I. Du Pont de Nemours and Company, Wilmington, Del.

[21] Appl. No.: 417,654

[22] Filed: Oct. 4, 1989

[51] Int. Cl.[5] ..... H62C 1/00

[52] U.S. Cl. ..... 169/45; 169/46; 252/605

[58] Field of Search ..... 169/43, 44, 45, 46, 169/47, 54; 252/2, 3, 601, 603, 605

[56] References Cited

U.S. PATENT DOCUMENTS

| | | | |
|---|---|---|---|
| 4,233,177 | 11/1980 | Wittenhorst | 252/605 |
| 4,234,432 | 11/1980 | Tarpley | 169/47 |
| 4,446,923 | 5/1984 | Martin | 169/45 |
| 4,807,706 | 2/1989 | Lambertsen et al. | 169/46 |

*Primary Examiner*—Sherman D. Basinger
*Assistant Examiner*—Stephen P. Avila

[57] ABSTRACT

A process for extinguishing, preventing and controlling fires using a composition containing $CHF_3$ is disclosed. $CHF_3$ can be used in volume percentages with air as high as 80% without adversely affecting mammalian habitation, with no effect on the ozone in the stratosphere and with little effect on the global warming process.

9 Claims, No Drawings

FIRE EXTINGUISHING COMPOSITION AND PROCESS

FIELD OF INVENTION

This invention relates to compositions for use in preventing and extinguishing fires based on the combustion of combustible materials. More particularly, it relates to such compositions that are "safe" to use—safe for humans and safe for the environment. Specifically, the compositions of this invention have little or no effect on the ozone layer depletion process; display little or no toxicity for humans; and make no or very little contribution to the global warming process known as the "greenhouse effect". Although these compositions have minimal effect in these three areas, they are extremely effective in preventing and extinguishing fires, particularly fires in enclosed spaces.

BACKGROUND OF THE INVENTION AND PRIOR ART

In preventing or extinguishing fires, two important elements must be considered for success: (1) separating the combustibles from air; and (2) avoiding or reducing the temperature necessary for combustion to proceed. Thus, one can smother small fires with blankets or with foams to cover the burning surfaces to isolate the combustibles from the oxygen in the air. In the customary process of pouring water on the burning surfaces to put out the fire, the main element is reducing temperature to a point where combustion cannot proceed. Obviously, some smothering or separation of combustibles from air also occurs in the water situation.

The particular process used to extinguish fires depends upon several items, e.g. the location of the fire, the combustibles involved, the size of the fire, etc. In fixed enclosures such as computer rooms, storage vaults, rare book library rooms, petroleum pipeline pumping stations and the like, halogenated hydrocarbon fire extinguishing agents are currently preferred. These halogenated hydrocarbon fire extinguishing agents are not only effective for such fires, but also cause little, if any, damage to the room or its contents. This contrasts to the well-known "water damage" that can sometimes exceed the fire damage when the customary water pouring process is used.

The halogenated hydrocarbon fire extinguishing agents that are currently most popular are the bromine-containing halocarbons, e.g. bromotrifluoromethane ($CF_3Br$, Halon 1301) and bromochlorodifluoromethane ($CF_2ClBr$, Halon 1211). It is believed that these bromine-containing fire extinguishing agents are highly effective in extinguishing fires in progress because, at the elevated temperatures involved in the combustion, these compounds decompose to form products containing bromine atoms which effectively interfere with the self-sustaining free radical combustion process and, thereby, extinguish the fire. These bromine-containing halocarbons may be dispensed from portable equipment or from an automatic room flooding system activated by a fire detector.

In many situations, enclosed spaces are involved. Thus, fires may occur in industrial or nuclear power plant control rooms, in military vehicles, and like areas where continuous human occupancy is almost mandatory. It is important that the fire extinguishing agents that are used continue to permit safe human occupancy in the enclosed space, despite their use.

The use of an effective amount of fire extinguishing agent in an atmosphere which would also permit human occupancy in the enclosed space involves two situations. In one situation, the fire extinguishing agent is introduced into the enclosed space to extinguish an existing fire; the second situation is to provide an ever-present atmosphere containing the fire "extinguishing" or, more accurably prevention agent in such an amount that fire cannot be initiated nor sustained. Thus, in U.S. Pat. No. 3,844,354, Larsen suggests the use of chloropentafluoroethane ($CF_3$—$CF_2Cl$) in a total flooding system (TFS) to extinguish fires in a fixed enclosure, the chloropentafluoroethane being introduced into the fixed enclosure to maintain its concentration at less than 15%. On the other hand, in U.S. Pat. No. 3,715,438 Huggett discloses creating an atmosphere in a fixed enclosure which is habitable but, at the same time, does not sustain combustion. Huggett provides an atmosphere consisting essentially of air, a perfluorocarbon selected from carbon tetrafluoride, hexafluoroethane, octafluoropropane and mixtures thereof and make-up oxygen, as required.

It has also been known that bromine-containing halocarbons such as Halon 1301 can be used to provide a habitable atmosphere that will not support combustion. However, the high cost due to bromine content and the toxicity to humans i.e. cardiac sensitization at relatively low levels (e.g. Halon 1301 cannot be used above 7.5–10%) make the bromine-containing materials unattractive for long term use.

In recent years, even more serious objections to the use of brominated halocarbon fire extinguishants has arisen. The depletion of the stratospheric ozone layer, and particularly the role of chlorofluorocarbons (CFC's) have led to great interest in developing alternative refrigerants, solvents, blowing agents, etc. It is now believed that bromine-containing halocarbons such as Halon 1301 and Halon 1211 are at least as active as chlorofluorocarbons in the ozone layer depletion process.

While perfluorocarbons such as those suggested by Huggett, cited above, are believed not to have as much effect upon the ozone depletion process as chlorofluorocarbons, their extraordinarily high stability makes them suspect in another environmental area, that of "greenhouse effect". This effect is caused by accumulation of gases that provide a shield against heat transfer and results in the undesirable warming of the earth's surface.

There is, therefore, a need for an effective fire extinguishing composition and process which can also provide safe human habitation and which composition contributes little or nothing to the stratospheric ozone depletion process or to the "greenhouse effect".

It is an object of the present invention to provide such a fire extinguishing composition; and to provide a process for preventing and controlling fire in a fixed enclosure by introducing into said fixed enclosure, an effective amount of the composition.

SUMMARY OF INVENTION

The present invention is based on the finding that an effective amount of a composition consisting essentially of trifluoromethane, $CHF_3$, will prevent and/or extinguish fire based on the combustion of combustible materials, particularly in an enclosed space, without adversely affecting the atmosphere from the standpoint of toxicity to humans, ozone depletion or "greenhouse effect".

The trifluoromethane may be used in conjunction with as little as 1% of at least one halogenated hydrocarbon selected from the group of difluoromethane, chlorodifluoromethane, 2,2-dichloro-1,1,1-trifluoroethane, 2-chloro-1,1,1,2-tetrafluoroethane, pentafluoroethane, 1,1,2,2-tetrafluoroethane, 1,1,1,2-tetrafluoroethane, dichloropentafluoropropanes, heptafluoropropanes, hexafluoropropanes, 1,2-dichloro-1,2-difluoroethane and 1,1-dichloro-1,2-difluoroethane.

One particularly surprisingly effective application of the invention is its use in providing a habitable atmosphere, as defined in Huggett U.S. Pat. No. 3,715,438. Thus, the invention would comprise a habitable atmosphere, which does not sustain combustion of combustible materials of the non-self-sustaining type, i.e. a material which does not contain an oxidizer component capable of supporting combustion, and which is capable of sustaining mammalian life, consisting essentially of (a) air; (b) trifluoromethane ($CHF_3$) in an amount sufficient to suppress combustion of the combustible materials present in an enclosed compartment containing said atmosphere; and, optionally if necessary, (c) make-up oxygen in an amount from zero to the amount required to provide, together with the oxygen in the air, sufficient total oxygen to sustain mammalian life.

The invention also comprises a process for preventing and controlling fire in an enclosed air-containing mammalian-habitable compartment which contains combustible materials of the non self-containing type which consists essentially of: (a) introducing $CHF_3$ into the air in the enclosed compartment in an amount sufficient to suppress combustion of the combustible materials in the enclosed compartment; and (b) introducing oxygen in an amount from zero to the amount required to provide, together with the oxygen present in the air, sufficient total oxygen to sustain mammalian life.

PREFERRED EMBODIMENTS

The trifluoroalkane, $CHF_3$, when added in adequate amounts to the air in a confined space, eliminates the combustion-sustaining properties of the air and suppresses the combustion of flammable materials, such as paper, cloth, wood, flammable liquids, and plastic items, which may be present in the enclosed compartment, without detriment to normal mammalian activities.

Trifluoromethane is extremely stable and chemically inert. $CHF_3$ does not decompose at temperatures as high as 400° C. to produce corrosive or toxic products and cannot be ignited even in pure oxygen so that it continues to be effective as a flame suppressant at the ignition temperatures of the combustible items present in the compartment. $CHF_3$ is also physiologically inert.

Trifluoromethane is additionally advantageous because of its low boiling point, i.e. a boiling point at normal atmospheric pressure of −82.1° C. Thus, at any low environmental temperature likely to be encountered, this gas will not liquefy and will not, thereby, diminish the fire preventive properties of the modified air. In fact, a material having such a low boiling point would be suitable as a refrigerant.

Trifluromethane is also characterized by an extremely low boiling point and a high vapor pressure, i.e. about 635 psig at 21° C. This permits $CHF_3$ to act as its own propellant in "hand-held" fire extinguishers. It may also be used with other materials such as those disclosed on page 5 of this specification to act as the propellant and co-extinguishant for these materials of lower vapor pressure. Its lack of toxicity (comparable to nitrogen) and its short atmospheric lifetime (with little effect on the global warming potential) compared to the perfluoroalkanes (with lifetimes of over 500 years) make $CHF_3$ ideal for this fire-extinguisher use.

To eliminate the combustion-sustaining properties of the air in the confined space situation, the gas should be added in an amount which will impart to the modified air a heat capacity per mole of total oxygen present, including any make-up oxygen required, sufficient to suppress or prevent combustion of the flammable, non-self-sustaining materials present in the enclosed environment. Surprisingly, we have found that with the use of $CHF_3$, the quantity of $CHF_3$ required to suppress combustion is sufficiently low as to eliminate the requirement for make-up oxygen.

The minimum heat capacity required to suppress combustion varies with the combustibility of the particular flammable materials present in the confined space. It is well known that the combustibility of materials, namely their capability for igniting and maintaining sustained combustion under a given set of environmental conditions, varies according to chemical composition and certain physical properties, such as surface area relative to volume, heat capacity, porosity, and the like. Thus, thin, porous paper such as tissue paper is considerably more combustible than a block of wood.

In general a heat capacity of about 40 cal./°C. and constant pressure per mole of oxygen is more than adequate to prevent or suppress the combustion of materials of relatively moderate combustibility, such as wood and plastics. More combustible materials, such as paper, cloth, and some volatile flammable liquids, generally require that the $CHF_3$ be added in an amount sufficient to impart a higher heat capacity. It is also desirable to provide an extra margin of safety by imparting a heat capacity in excess of minimum requirements for the particular flammable materials. A minimum heat capacity of 45 cal./°C. per mole of oxygen is generally adequate for moderately combustible materials and a minimum of about 50 cal./°C. per mole of oxygen for highly flammable materials. More can be added if desired but, in general, an amount imparting a heat capacity higher than about 55 cal./°C. per mole of total oxygen adds substantially to the cost and may create unnecessary physical discomfort without any substantial further increase in the fire safety factor.

Heat capacity per mole of total oxygen can be determined by the formula:

$$C_p^* = (C_p)_{o2} + \sum_z \frac{P_z}{P_{o2}} (C_p)_z$$

wherein:

$C_p^*$ = total heat capacity per mole of oxygen at constant pressure;

$P_{o2}$ = partial pressure of oxygen;

$P_z$ = partial pressure of other gas;

$(C_p)_z$ = heat capacity of other gas at constant pressure.

The boiling point of $CHF_3$ and the mole percent required to impart to air heat capacities ($C_p$) of 40 and 50 cal./°C. at a temperature of 25° C. and constant pressure while maintaining a 21% oxygen content are tabulated on the following below:

| | Boiling point, °C. | $C_p = 40$ percent | $C_p = 50$ percent |
|---|---|---|---|
| $CHF_3$ | −82.1 | 21.5 | 62.0* |

*It will be noted from Example 2 that $CHF_3$ is not toxic at concentrations up to about 80%.

The concentration of oxygen available in the confined air space should be sufficient to sustain mammalian life. The amount of make-up oxygen, if required, is determined by such factors as degree of air dilution by the $CHF_3$ gas and depletion of the available oxygen in the air by human respiration. The amount of oxygen required to sustain human, and therefore mammalian life in general, at atmospheric, subatmospheric, and superatmospheric pressures, is well known and the necessary data are readily available. See, for example, Paul Webb, Bioastronautics Data Book, NASA SP-3006, National Aeronautics and Space Administration, 1964, p. 5. The minimum oxygen partial pressure is considered to be about 1.8 p.s.i.a., with amounts above 8.2 p.s.i.a. causing oxygen toxicity. At normal atmospheric pressures at sea level, the unimpaired performance zone is in the range of about 16 to 36 volume percent of oxygen. The normal amount of oxygen maintained in a confined space is about 16% to about 21% at normal atmospheric pressure.

In most applications using $CHF_3$, no make-up oxygen will be required initially or even thereafter, since the $CHF_3$ volume requirement even when the starting oxygen amount of 21% decreased to 16%, is extremely small. However, habitation for extended periods of time will generally require addition of oxygen to make up the depletion caused by respiration.

Introduction of the $CHF_3$ gas and any oxygen is easily provided for by metering appropriate quantities of the gas or gases into the enclosed air-containing compartment.

The air in the compartment can be treated at any time that it appears desirable. The modified air can be used continuously if a threat of fire is constantly present or the particular environment is such that fire hazard must be kept at an absolute minimum, or it can be used as an emergency measure if a threat of fire develops.

As stated previously, small amounts of one or more of the compounds set forth on page 5 may be used along with the $CHF_3$ gas without upsetting the mammalian habitability or losing the other advantages of $CHF_3$.

The invention will be more clearly understood by referring to the examples which follow. The unexpected effects of $CHF_3$, and $CHF_3$ in the aforementioned blends, in suppressing and combatting fire, as well as its compatability with the ozone layer and its relatively low "greenhouse effect", when compared to other fire-combatting gases, particularly the perfluoroalkanes, are shown in the examples.

EXAMPLE 1

Fire Extinguishing Concentrations

The fire extinguishing concentration of $CHF_3$ and blends with one or more of $CHF_2Cl$, $C_2H_2F_4$ and $C_2HF_5$, compared to several controls, was determined by the ICI Cup Burner method. This method is described in "Measurement of Flame-Extinguishing Concentrations" R. Hirst and K. Booth, Fire Technology, vol. 13(4): 296–315 (1977).

Specifically, an air stream is passed at 40 liters/minute through an outer chimney (8.5 cm. I. D. by 53 cm. tall) from a glass bead distributor at its base. A fuel cup burner (3.1 cm. O.D. and 2.15 cm. I.D.) is positioned within the chimney at 30.5 cm. below the top edge of the chimney. The fire extinguishing agent is added to the air stream prior to its entry into the glass bead distributor while the air flow rate is maintained at 40 liters/minute for all tests. The air and agent flow rates are measured using calibrated rotameters.

Each test is conducted by adjusting the fuel level in the reservoir to bring the liquid fuel level in the cup burner just even with the ground glass lip on the burner cup. With the air flow rate maintained at 40 liters/minute, the fuel in the cup burner is ignited. The fire extinguishing agent is added in measured increments until the flame is extinguished. The fire extinguishing concentration is determined from the following equation:

$$\text{Extinguishing concentration} = \frac{F_1}{F_1 + F_2} \times 100$$

where $F_1$ = Agent flow rate $F_2$ = Air flow rate

Two different fuels are used, heptane and methanol; and the average of several values of agent flow rate at extinguishment is used for the following table.

TABLE 1

Extinguishing Concentrations of $CHF_3$ and Blends Compared to Other Agents

| | Fuel | | Flow Rate | | |
|---|---|---|---|---|---|
| | Heptane Extinguishing Conc. | Methanol Extinguishing Conc. | Air | Agent (1/min) | |
| Agent | (vol. %) | (vol. %) | (1/min) | Hept. | Meth. |
| $CHF_3$ | 14.0 | 23.8 | 40.1 | 65.2 | 12.48 |
| Blend 1 | 12.4 | 18.8 | 40.1 | 5.70 | 9.30 |
| Blend 2 | 10.8 | 17.1 | 40.1 | 4.86 | 8.27 |
| Blend 3 | 11.4 | 16.8 | 40.1 | 5.16 | 8.10 |
| Blend 4 | 10.9 | 16.9 | 40.1 | 4.91 | 8.16 |
| $CF_4$ | 20.5 | 23.5 | 40.1 | 10.31 | 12.34 |
| $C_2F_6$ | 8.7 | 11.5 | 40.1 | 3.81 | 5.22 |
| F-134a* | 11.5 | 15.7 | 40.1 | 5.22 | 7.48 |
| H-1301** | 4.2 | 8.6 | 40.1 | 1.77 | 3.77 |
| $CHF_2Cl$ | 13.6 | 22.5 | 40.1 | 6.31 | 11.64 |
| F-125*** | 10.1 | 13.0 | 40.1 | 4.51 | 5.99 |

Blend 1 - wt. % $CHF_3$ (35.2) $CHF_2Cl$ (36.9) F-134a (27.9)
Blend 2 - wt. % $CHF_3$ (25) F-125 (75)
Blend 3 - wt. % $CHF_3$ (30) F-125 (35) F-134a (35)
Blend 4 - wt. % $CHF_3$ (30) $CHF_3Cl$ (25) F-125 (45)
*tetrafluoroethane
**$CF_3Br$
***pentafluoroethane

EXAMPLE 2

Cardiac Sensitivity

The cardiac sensitivity or toxicity of $CHF_3$ and various blends of $CHF_3$, compared to several controls, was determined using the methods described in "Relative Effects of Haloforms and Epinephrine on Cardiac Automaticity" R. M. Hopkins and J. C. Krantz, Jr., Anesthesia and Analgesia, vol. 47 no. 1 (1968) and "Cardiac Arrhythmias and Aerosol 'Sniffing'" C. F. Reinhardt et al. Arch. Environ. Health vol. 22 (February 1971).

Specifically, the cardiac sensitivity is measured using unanesthesized, healthy dogs using the general protocal set forth in the Reinhardt et al article. First, for a limited period, the dog is subjected to air flow through a semi-closed inhalation system connected to a cylindrical face mask on the dog. Then, epinephrine hydrochloride (adrenaline), diluted with saline solution, is administered intravenously and the electrocardiograph is recorded. Then air containing various concentrations of the agent being tested is administered followed by a second injection of epinephrine. The concentrations of agent necessary to produce a disturbance in the normal conduction of an electrical impulse through the heart as characterized by a serious cardiac arrhythmia, are shown in the following table.

TABLE 2

| Agent | Threshhold Cardiac Sensitivity (vol. % in air) |
|---|---|
| $CHF_3$ | 80 |
| $CF_4$ | 60 |
| $C_2F_6$ | 20 |
| F-134a | 7.5 |
| H-1301 | 7.5 |
| $CHF_2Cl$ | 5.0 |

EXAMPLE 3

The ozone depletion potential (ODP) of $CHF_3$ and various blends containing $CHF_3$, compared to various controls, was calculated using the method described in "The Relative Efficiency of a Number of Halocarbon for Destroying Stratospheric Ozone" D. J. Wuebles, Lawrence Livermore Laboratory report UCID-18924, (January 1981) and "Chlorocarbon Emission Scenarios: Potential Impact on Stratospheric Ozone" D. J. Wuebles, Journal Geophysics Research, 88, 1433–1443 (1983).

Basically, the ODP is the ratio of the calculated ozone depletion in the stratosphere resulting from the emission of a particular agent compared to the ODP resulting from the same rate of emission of FC-11 ($CFCl_3$) which is set at 1.0. Ozone depletion is believed to be due to the migration of compounds containing chlorine or bromine through the troposphere into the stratosphere where these compounds are photolyzed by UV radiation into chlorine or bromine atoms. These atoms will destroy the ozone ($O_3$) molecules in a cyclical reaction where molecular oxygen ($O_2$) and [ClO] or [BrO] radicals are formed, those radicals reacting with oxygen atoms formed by UV radiation of $O_2$ to reform chlorine or bromine atoms and oxygen molecules, and the reformed chlorine or bromine atoms then destroying additional ozone, etc., until the radicals are finally scavenged from the stratosphere. It is estimated that one chlorine atom will destroy 10,000 ozone molecules and one bromine atom will destroy 100,000 ozone molecules.

The ozone depletion potential is also discussed in "Ultraviolet Absorption Cross-Sections of Several Brominated Methanes and Ethanes" L. T. Molina, M. J. Molina and F. S. Rowland" J. Phys. Chem. 86, 2672–2676 (1982); in Bivens et al. U.S. Pat. No. 4,810,403; and in "Scientific Assessment of Stratospheric Ozone: 1989" U.N. Environment Programme (21 August 1989).

In the following table, the ozone depletion potentials are presented for $CHF_3$, the blends of $CHF_3$ as set forth in Example 1, and the controls.

TABLE 3

| Agent | Ozone Depletion Potential |
|---|---|
| $CHF_3$ | 0 |
| $CF_4$ | 0 |
| $C_2F_6$ | 0 |
| F-134a | 0 |
| H-1301 | 10 |
| $CHF_2Cl$ | 0.05 |
| H-1211 | 3 |
| $CFCl_3$ | 1 |
| Blend | |
| 1 | 0.0125 |
| 2 | 0 |
| 3 | 0 |
| 4 | 0.0125 |

EXAMPLE 4

The global warming potentials (GWP) of $CHF_3$ and various blends containing $CHF_3$, compared to several controls, was determined using the method described in "Scientific Assessment of Stratospheric Ozone: 1989" sponsored by the U.N. Environment Programme.

The GWP, also known as the "greenhouse effect" is a phenomenon that occurs in the troposphere. It is calculated using a model that incorporates parameters based on the agent's atmospheric lifetime and its infra-red cross-section or its infra-red absorption strength per mole as measured with an infra-red spectrophotometer.

The general definition is:

$$GWP = \frac{\text{Calculated IR forcing due to agent}}{\text{Emission rate (steady state) of agent}}$$

divided by the same ratio of parameters for $CFCl_3$.

In the following table, the GWP's are presented for $CHF_3$, the blends of $CHF_3$ as set forth in Example 1 and the controls.

TABLE 4

| Agent | Global Warming Potential |
|---|---|
| $CHF_3$ | 1–3 |
| $CF_4$ | greater than 5 |
| $C_2F_6$ | greater than 8 |
| F-134a | 0.25 |
| $CHF_2Cl$ | 0.35 |
| $CFCl_3$ | 1.0 |
| Blend 1 | 0.6 |
| Blend 2 | 0.7 |
| Blend 3 | 0.6 |
| Blend 4 | 0.7 |

We claim:

1. A process for preventing, controlling and extinguishing in an enclosed air-containing, mammalian-habitable enclosed area which contains combustible materials of the non-self-sustaining type, which comprises introducing into the air in said enclosed area a composition containing at least 25 weight percent of $CHF_3$ in gaseous form sufficient to impart a heat capacity per mol of total oxygen that will suppress combustion of the combustible materials in said enclosed area.

2. A process as in claim 1 wherein make-up oxygen is also introduced into said enclosed area in an amount from zero to the amount required to provide, together with the oxygen present in said air, sufficient total oxygen to sustain mammalian life.

3. A process as in claim 1 wherein the amount of $CHF_3$ in said enclosed area is maintained at a level of about 14 to 80 volume percent.

4. A process as in claim 1 wherein the amount of $CHF_3$ in said enclosed area is maintained at about 24 volume percent.

5. A process as in claim 1 wherein at least 1 weight % of at least one halogenated hydrocarbon is blended with said $CHF_3$ introduced into said enclosed area, said halogenated hydrocarbon being selected from the group consisting of difluoromethane, chlorodifluoromethane, 2,2-dichloro-1,1,1-trifluoroethane, 2-chloro-1,1,1,2-tetrafluoroethane, pentafluoroethane, 1,1,2,2-tetrafluoroethane, 1,1,1,2-tetrafluoroethane, dichloropentafluoropropanes, heptafluoropropanes, hexafluoropropanes, 1,2-dichloro-1,2-difluoroethane and 1,1-dichloro-1,2-difluoroethane.

6. A process for extinguishing a fire which comprises introducing a composition containing at least 25 weight % of $CHF_3$ in gaseous form sufficient to provide an extinguishing concentration in an enclosed area, and maintaining said concentration at a value of less than 80 volume percent until said file is extinguished.

7. A process as in claim 6 wherein at least 1 weight % of at least one halogenated hydrocarbon is blended with said $CHF_3$ introduced into said enclosed area, said halogenated hydrocarbon being selected from the group consisting of difluoromethane, chlorodifluoromethane, 2,2-dichloro-1,1,1-trifluoroethane, 2-chloro-1,1,2,2-tetrafluoroethane, 1,1,1,2-tetrafluoroethane, dichloropentafluoropropanes, heptafluoropropanes, hexafluoropropanes, 1,2-dichloro-1,2-difluoroethane and 1,1-dichloro-1,2-difluoroethane.

8. A fire extinguishing composition of low toxicity comprising a gaseous mixture containing at least 25 weight percent of $CHF_3$ in gaseous form.

9. The composition of claim 8 wherein at least 1 weight % of at least one halogenated hydrocarbon is blended with said $CHF_3$, said halogenated hydrocarbon being selected from the group consisting of difluoromethane, chlorodifluoromethane, 2,2-dichloro-1,1,1-trifluoroethane, 2-chloro-1,1,1,2-tetrafluoroethane, pentafluoroethane, 1,1,2,2-tetrafluoroethane, 1,2,2,2-tetrafluoroethane, dichloropentafluoropropanes, heptafluoropropanes, hexafluoropropanes, 1,2-dichloro-1,2-difluoroethane and 1,1-dichloro-1,2-difluoroethane.

* * * * *

UNITED STATES PATENT AND TRADEMARK OFFICE
Certificate

Patent No. 5,040,609 Patented: August 20, 1991

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Richard E. Fernandez, Bear, Delaware (US).

Signed and Sealed this Sixth Day of February 2007.

DEBORAH JONES
*Supervisory Patent Examiner*
Art Unit 3991